US005101823A

United States Patent [19]

Smith

[11] Patent Number: 5,101,823

[45] Date of Patent: Apr. 7, 1992

[54] TANNING POOL

[76] Inventor: Gary Smith, 2550 Dumont, Baton Rouge, La. 70815

[21] Appl. No.: 684,431

[22] Filed: Apr. 10, 1991

Related U.S. Application Data

[60] Continuation of Ser. No. 526,546, May 18, 1990, abandoned, which is a continuation of Ser. No. 323,443, Mar. 14, 1989, abandoned, which is a division of Ser. No. 76,497, Jul. 22, 1987, abandoned, which is a continuation-in-part of Ser. No. 929,726, Nov. 12, 1986, abandoned.

[51] Int. Cl.[5] ..... A61H 33/00

[52] U.S. Cl. ..... 128/369; 5/284; 5/419; 128/376; 128/372

[58] Field of Search ..... 128/369, 376, 372, 377; 5/449, 457, 284, 455, 473, 417, 474, 419, 420; 40/40, 41, 135

[56] References Cited

U.S. PATENT DOCUMENTS

| | | | |
|---|---|---|---|
| 3,170,172 | 2/1965 | Kessman | 128/372 |
| 3,513,489 | 5/1970 | Miller | 5/449 |
| 3,610,249 | 10/1971 | Bater | 128/372 |
| 3,688,775 | 9/1972 | Raymann | 128/372 |
| 3,835,482 | 9/1974 | Tersch | 128/372 |
| 3,997,927 | 12/1976 | Culligan | 5/420 |
| 4,320,744 | 3/1982 | Fodor et al. | 128/372 |
| 4,476,593 | 10/1984 | Famselow | 5/417 |
| 4,489,452 | 12/1984 | Lickert | 5/465 |

FOREIGN PATENT DOCUMENTS 611144 5/1979 Switzerland .

*Primary Examiner*—William H. Grieb
*Assistant Examiner*—Mark S. Graham
*Attorney, Agent, or Firm*—Pravel, Gambrell, Hewitt, Kimball & Krieger

[57] ABSTRACT

An apparatus for sun bathing, which includes an inflatable floor portion substantially rectangular in nature for supporting the length of a user lying on one's back or stomach; a continuous inflatable side wall portion rising the height above the floor portion and attach integral thereto, the side portion having a head rest portion, likewise inflatable for allowing the user to rest his head on that portion of the head rest portion while placement upon the position within the apparatus. For purposes of use, the apparatus is more particularly suitable for using on a hard surface, and to be filled with a predetermined quantity of fluid such as water in order to maintain the user cool during use. The apparatus may also be constructed of transparent plastic for allowing sun's rays through the wall of the apparatus yet have a reflective surface floor portion so that the sun's rays may be directed to other parts of a person's body which would not normally be exposed to the sun while laying in position within the apparatus.

4 Claims, 2 Drawing Sheets

TANNING POOL

This is a continuation of Ser. No. 526,546, May 18, 1990, abandoned, which is a continuation of Ser. No. 323,443, Mar. 14, 1989, abandoned, which is a Division of Ser. No. 076,497, July 22, 1987, abandoned, which is a continuation-in-part of Ser. No. 929,726, Nov. 12, 1986 abandoned.

BACKGROUND OF THE INVENTION

1. Field Of The Invention

The apparatus of the present invention relates to sun bathing. More particularly, the apparatus of the present invention relates to an inflatable apparatus for placement onto a firm foundation for a person to recline in having a predetermined depth of water for obtaining a sun tan while submerged within the water.

2. General Background

One of the most common pleasant past times of individuals is to relax on the side of a pool or other body of water in order to obtain a sun tan. The past time of sun tanning for the most part is done by individuals who during the course of swimming may choose to lie on the beach, on a towel, or in a recliner chair on the side of a pool and allow the sun's rays to burn or tan the exposed skin. However, due to the nature of sun tanning, and the effect of the sun's rays on the body, it is often very uncomfortable after a period for an individual to be laying in the hot sun on a surface such as a chair or a towel which offers no relief from the sun's rays, and for the most part one must continue sun bathing in some discomfort. On the other hand, if one attempts to remain in the water while sun bathing, it does not accomplish the results of obtaining a sun tan over the entire surface of the exposed skin in view of the fact that a great portion of the skin is deep beneath the water and is not, affected by the sun's rays, therefore uneven tanning is accomplished. If one chooses therefore to lie on a mattress floating on the water, the effects of the sun's rays on a person laying on an air mattress, although afloat in water, is likewise unpleasant as would be laying on the side of a pool or on the beach.

Therefore, there is a need in the art for an apparatus which would allow one to sun bathe next to a pool or a similar body of water, or even without a pool in one's backyard, for example, yet at the same time may take advantage of being submerged, within a certain quantity of water during the sun bathing. This concept has been addressed in several patents, the most pertinent being as follows:

U.S. Pat. No. 3,688,775 issued to Raymann, entitled "Sun Bathing And Tanning Apparatus", relates to a sun bathing apparatus which may be an inflatable mattress having an interior portion wherein water is sprinkled into the mattress from a water sprinkling means so that the person laying within the confined area is kept cool from the water sprayed therein.

U.S. Pat. No. 4,151,618 issued to Carpenter, entitled "Water Sheet", relates to a device for cooling a person who may be sun bathing, which comprises a flexible, water proof material such as plastic to receive the body in the reclined position. There is a head portion provided with a suitable pillow cushion for the bather. For the most part, the apparatus would be used in combination with a reclining chair or the like.

U.S. Pat. No. 4,476,593 issued to Fanselow et al., entitled "Tanning Blanket", relates to a blanket utilizing a plurality of oriented flexible incremental reflectors within the blanket so that a person laying on the blanket is able to take advantage of the sun's rays when sun bathing while reclined on the blanket.

U.S. Pat. No. 4,320,744 issued to Fodor, et al., entitled "Solar Heated Portable Structure", relates to a structure having a flexible bottom panel, flexible side assembly and flexible transmitting panel coupled to the bottom and side assembly forming an enclosed chamber and is capable of transmitting the majority of the radiating energy from solar radiation to the enclosed chamber like a sauna.

U.S. Pat. No. 3,610,249 issued to Baker, entitled "Sun Reflector Booth", relates to a booth having identical panels for sun bathing, each of the panels being formed of a light reflected sheet framed by intersecting tubular members wherein a user would position himself within the booth for sun tanning.

U.S. Pat. No. 3,170,172 issued to Kessman, entitled "Sun Bathing Device", provides a device in such a way that upwardly facing and downwardly facing surfaces of the body of the user will be uniformly exposed to the sun's rays simultaneously in order to reduce the time required for tanning and eliminate the need for changes of position.

U.S. Pat. No. 3,997,927 issued to Culligan, entitled "Sun Bathing Mat Assembly", relates to an assembly wherein cooling water for the under surfaces of the body lying in the sun bathing position without applying water to the upper surface exposed to the sun's rays. The invention comprises a soft foam mat to be laid on slightly sloping surface of a lawn or yard in combination with a conduit fronting along one edge for providing water along the mat to cool the user and yet allow the user to sun bathe.

U.S. Pat. No. 3,835,482 issued to Tersch, entitled "Sun Tanning Tub", relates to a molded tub having an elongated rectangular bottom and side and end walls projecting upwardly therefrom to define a shallow receptacle capable of holding water with the end walls being of different height so that the receptacle increases in depth from the foot to the head portion.

SUMMARY OF THE PRESENT INVENTION

The apparatus of the present invention provides a tanning pool which includes an inflatable floor portion substantially rectangular in nature for supporting the length of a user lying on one's back or stomach, the floor portion including a plurality of transverse baffle members between the upper and lower surfaces of the floor portion for providing structural integrity to the floor portion and the upper portion while the floor is in the inflated state, a continuous inflatable side wall portion rising a height above the inflated floor portion and integrally attached thereto, the side portion having a head rest portion, likewise inflatable, and detachable therefrom via velcro or like fastening means, for allowing the user to have the option of resting one's head on that portion of the head rest portion while placed in position within the apparatus, or to remove it for lying in the completely prone position. For purposes of use, the apparatus is more particularly suitable for using on a hard surface, and to be filled with a predetermined quantity of fluid such as water in order to maintain the user cool during use. The apparatus may also be constructed of transparent plastic for allowing sun's rays through the wall of the apparatus, yet having a reflective surface floor portion so that the sun's rays may be directed to other parts of a person's body which would not normally be exposed to the sun while laying in position within the apparatus.

Therefore it is an object of the present invention to provide an apparatus which is easily transportable and may be inflated upon assembling for use;

It is still a further object of the present invention to provide a sun bathing apparatus having a separate inflatable floor portion from the inflatable wall portion, so that inflation of the apparatus defines a retaining area for a person to lay within and is able to contain a quantity of water within the confines of the wall; and It is still a further object of the present invention to provide a sun bathing apparatus wherein there is further included a head rest detachable from the face of one of the end portions for allowing a person's head to rest thereupon, or when removed, for lying prone or to be removed and the apparatus used as a "mini-pool"; and It is still a further object of the present invention provide a sun-bathing apparatus having an inflatable floor portion, which includes a plurality of transverse baffles to provide structural integrity to the inflated floor portion and the upper wall portion while a person is lying thereupon.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
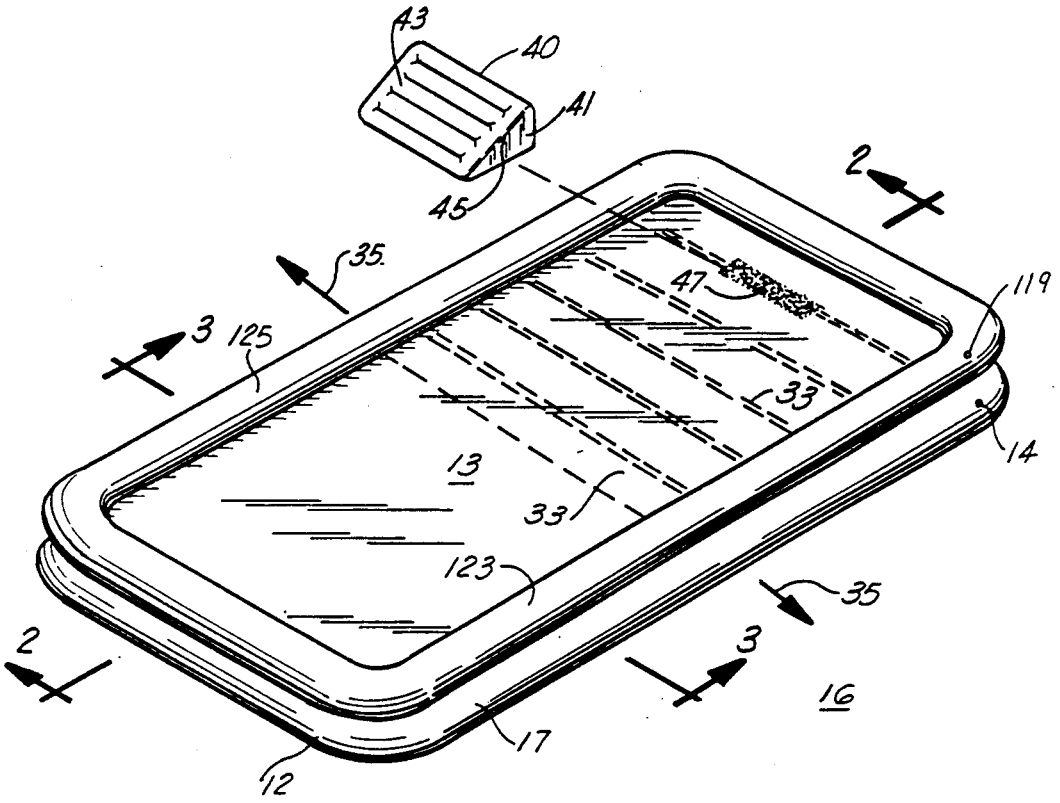
FIG. 1 is an overall perspective view of the preferred embodiment of the apparatus of the present invention.

FIGS. 1-4 illustrate the preferred embodiment of the apparatus of the present invention by the numeral 10. In FIGS. 1-4 there is illustrated apparatus 10 which is designed for allowing a person to position himself in the prone position within the apparatus for tanning or the like. What is provided in apparatus 10 is an inflatable floor portion 12 having a upper surface 13 for lying thereupon, and a lower surface 15, and a continuous side wall 17 together which defines a space 19 therewithin for filling with a volume of air to define the inflated floor portion for support of a human body lying upon it in comfort. Floor portion 12 is inflated via air valve 14 which would be a standard type of valve of the type which may be a check valve for allowing air to be blown into the floor portion and inflated. For purposes of illustration in its preferred use, apparatus 10 would be used on a solid surface 16, as seen in FIG. 1 of the type which may be a beach or that area around a pool.

For purposes of construction, floor portion 12 is formed of an upper rectangular section 21 (See FIG. 2) fused at seam 23 to a lower rectangular section 25 to form the composite floor portion 12 as seen in the inflated state in the Figures. This construction of the seam substantially within the mid line of the cross-section of the floor portion enables the provision of the curved corners 27 as seen in the Figures.

Figure 2:
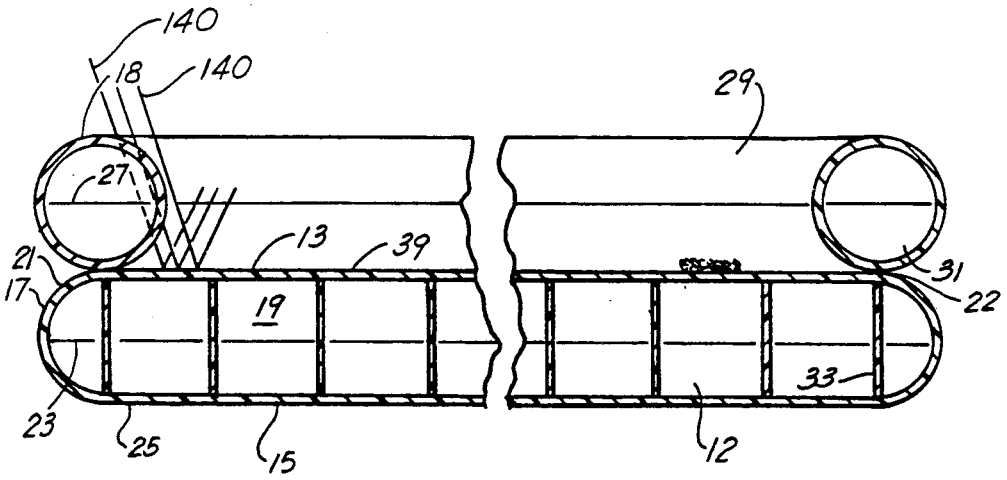
FIG. 2 is a cross-sectional side view along lines 2—2 of FIG. 1 of the preferred embodiment of the apparatus of the present invention.
Figure 3:
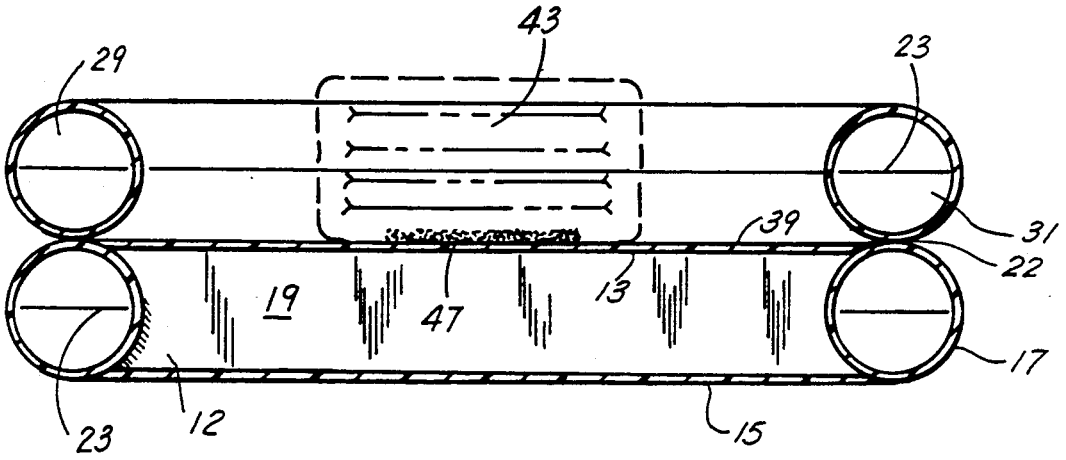
FIG. 3 is a cross-sectional end view of the preferred embodiment of the apparatus of the present invention.

In addition, apparatus 10 further includes a continuous inflatable upper side or ring portion 18 which is inflatable via valve 119 and would inflate to a height substantially above the height of the floor portion 12 and would form a continuous wall 21 around the outer perimeter of the floor portion 12 yet resting completely thereupon as seen in FIG. 2. In addition, inflatable upper wall portion 18 would form a fluid tight seal at the interface 22 between the floor portion 12 and the wall portion 18. Likewise, inflated wall portion 18 would also include a continuous seam 27 which forms a composite seam between the upper portion 29 of wall portion 18 and the lower portion 31 of wall portion 18 to form the composite wall portion.

As seen in the overall perspective view in FIG. 1, and in cross-sectional view in FIG. 2, floor portion 12 includes a plurality of transverse baffles 33 attached at their upper most edge to upper surface 13 and their lower most edge to lower surface 15, with transverse baffles 33 extending substantially the width of floor portion 12. Baffles 33 would provide a means for assuring that the structural integrity of the floor portion 12 would be maintained in substantially the rigid rectangular shape as seen in FIG. 1 when a person is lying thereupon. Baffles 33 would eliminate the possibility of the outermost wall of floor portion 12 and the upper wall or ring portion 18 being diverted outward in the direction of Arrows 35 as seen in FIG. 1.

Figure 4:
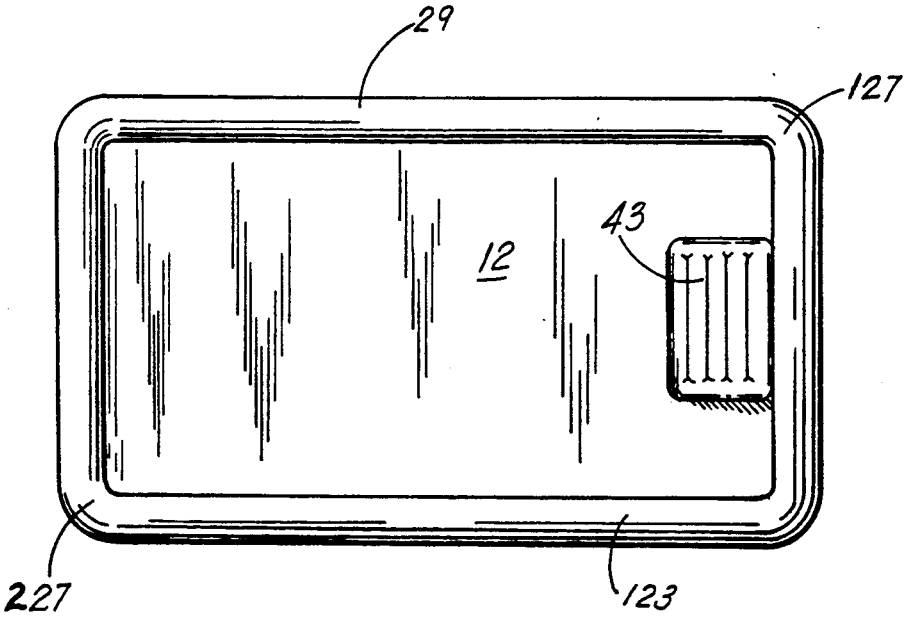
FIG. 4 is a top view of the preferred embodiment of the apparatus of the present invention.

In the preferred embodiment, the parallel side walls 123 and 125 would be of equal length and shape and would continue to front end portion 127 of the same shape as rear end portion 227 so that the wall portion 18 would simply define a water proof barrier as will be described further. The removable head rest portion 40 would comprise a means for allowing the user of the apparatus to rest his head while tanning in the sun. This head rest portion 40 would comprise a wedge shape pillow 41 which would define a means for resting ones head thereupon, the pillow 41 including an upper angulated surface 43 where one's head is placed and a substantially flat bottom surface 45 having a velcro strip (not illustrated), which would be accommodated to a second velcro strip 47 as seen in FIG. 1 attached to the upper face 13 of floor portion 12. Therefore, pillow 41 is a removable head rest means, which would allow the user to utilize the pillow as seen in FIG. 4, or to remove the pillow and to simply lay in the completely prone position.

In addition to this structure of the apparatus there would be further included in the preferred embodiment a reflective surface 39 which would cover the entire interior floor portion 12 for allowing the sun's rays 140 to be directed in a reflective fashion off of reflective surface 39 onto the user of the apparatus.

Further, in the preferred embodiment, the wall portion 18, would be for the most part constructed of transparent material so that any sun's rays 140 entering the apparatus, could penetrate through the side walls 123 and 125 yet be reflected off of a reflective surface 39.

The user likewise in the preferred embodiment of the apparatus would, prior to use of the apparatus, fill the interior portion bounded by the wall portion 18 with water so that the user may be partially or fully submerged within the water while tanning in the apparatus. By doing such, the user would be kept quite cool yet continue to take full advantage of the sun's rays in tanning.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A sun bathing pool apparatus comprising:

a) a substantially rectangular inflatable base portion, including upper and lower vertically spaced apart generally rectangular surfaces, and including a plurality of parallel inflatable base chambers therewithin extending substantially over the area of the upper and lower surface;

b) a substantially continuous inflatable cylindrically shaped tubular side wall mounted on top of and extending above the upper generally rectangular surface of the inflatable base portion;

c) the continuous inflatable cylindrical tubular side wall surrounding the upper generally rectangular surface and forming a seal therewith, so that the tubular side wall defines a water holding portion in combination with the upper generally rectangular surface of the inflatable base portion;

d) a pillow portion extending above the upper generally rectangular surface for placing ones head thereupon;

e) first and second inflation means mounted respectively on the base portion and on the continuous side wall, so that the base portion can be inflated separately from the side wall;

f) the inflatable base portion having a reflector surface for reflecting sun rays toward the user; and g) the plurality of inflatable base chambers defined by an array of generally vertically extending and closely spaced baffles of generally uniform height positioned between the upper and lower generally rectangular surfaces of the inflatable base portion, and substantially over the area of the upper and lower generally rectangular surfaces, the baffles each forming a connection to the upper and lower surfaces of the base portion for maintaining a generally flattened texture to the upper generally horizontal surface when the base portion is inflated and adding structural integrity to the inflatable base when the base portion is inflated and a person is lying thereupon.

2. The apparatus in claim 1, wherein the upper and lower surface are spaced apart sufficiently so that when the base portion is inflated a user can lay prone on the base portion in comfort even with a hard underlying surface supporting the base portion.

3. The apparatus in claim 1, wherein the side wall is sealed to the upper surface of the base portion for allowing water to be placed upon the base portion upper surface so that a person lying on the upper surface is at least partially submerged in the water.

4. A sun bathing pool apparatus comprising:

a) a substantially rectangular inflatable base portion, including upper and lower vertically spaced apart generally rectangular surfaces, and including a plurality of parallel inflatable base chambers therewithin extending substantially over the area of the upper and lower surface;

b) a substantially continuous inflatable tubular side wall mounted upon and extending above the upper generally rectangular surface of the inflatable base portion;

c) the continuous inflatable tubular side wall surrounding the upper generally rectangular surface to define a water holding portion in combination with the upper generally rectangular surface of the inflatable base portion;

d) the peripheral, inflatable tubular side wall providing a pillow portion at a position above the upper generally rectangular surface portion, for placing ones head thereupon;

e) first and second inflation means contained respectively on the base portion and on the continuous side wall, so that the base portion can be inflated separately from the side wall;

f) means on the base portion for serving as a sun reflector surface;

g) the plurality of inflatable base chambers defined by an array of generally vertically extending baffles of generally uniform height positioned between the upper and lower generally rectangular surfaces of the inflatable base portion, and substantially over the area of the upper and lower generally rectangular surfaces, the baffles each forming a connection to the upper and lower surfaces of the base portion for maintaining a generally flattened texture to the upper generally horizontal surface when the base portion is inflated and adding structural integrity to the inflatable base portion when the base portion is inflated and a person is lying thereupon; and h) wherein the side wall is of substantially transparent material so that sun rays may penetrate the side wall to be reflected off of the upper surface.

* * * * *